US010996038B2

(12) United States Patent
Johnson et al.

(10) Patent No.: US 10,996,038 B2
(45) Date of Patent: May 4, 2021

(54) CORELESS-COIL SHOCK TUBE PACKAGE SYSTEM

(71) Applicant: Ensign-Bickford Aerospace & Defense Company, Simsbury, CT (US)

(72) Inventors: Alan L. Johnson, Madisonville, KY (US); P. Cary Franklin, Madisonville, KY (US)

(73) Assignee: ENSIGN-BICKFORD AEROSPACE & DEFENSE COMPANY, Simsbury, CT (US)

( * ) Notice: Subject to any disclaimer, the term of this patent is extended or adjusted under 35 U.S.C. 154(b) by 76 days.

(21) Appl. No.: 16/376,078

(22) Filed: Apr. 5, 2019

(65) Prior Publication Data

US 2020/0318938 A1 Oct. 8, 2020

(51) Int. Cl.

| | |
|---|---|
| ***F42B 39/30*** | (2006.01) |
| ***C06C 5/04*** | (2006.01) |
| ***F42D 1/04*** | (2006.01) |

(52) U.S. Cl.

CPC ..... *F42B 39/30* (2013.01); *C06C 5/04* (2013.01); *F42D 1/043* (2013.01)

(58) Field of Classification Search

CPC ..... B65D 85/00; F42B 39/30; F42D 1/043; C06C 5/00; C06C 5/04; C06C 5/06

USPC ..... 102/202.3, 275.1, 502; 206/388, 389, 206/398–419

See application file for complete search history.

(56) References Cited

U.S. PATENT DOCUMENTS

| | | | |
|---|---|---|---|
| 1,631,756 | A | 6/1927 | Olin |
| 2,514,542 | A | 7/1950 | Guest |
| 3,590,739 | A | 7/1971 | Persson |
| 4,102,428 | A | 7/1978 | Kelly et al. |
| 4,166,418 | A | 9/1979 | Calder, Jr. |
| 4,328,753 | A | 5/1982 | Kristensen et al. |

(Continued)

FOREIGN PATENT DOCUMENTS

| | | | |
|---|---|---|---|
| WO | 2018188690 | A1 | 10/2018 |
| WO | 2019004495 | A1 | 1/2019 |

OTHER PUBLICATIONS

International Search Report for International Application No. PCT/US2020/023319, International Filing Date Mar. 18, 2020, dated Jun. 25, 2020, 5 pages.

(Continued)

*Primary Examiner* — Bryon P Gehman

(74) *Attorney, Agent, or Firm* — Cantor Colburn LLP

(57) ABSTRACT

A coreless-coil shock tube package system includes a "coreless" bundle of shock tubing, meaning that the tubing is not wrapped around a spool. The bundle may be a generally cylindrical coil of shock tubing. Optionally, two washer-like end plates abut the ends of the tubing coil for axial support. A self-adhesive tape covering partially covers the coil and end plates. A detonator is attached to one end of the tubing and lies tucked into the coil, through an end plate, for storage and transport. An igniter is attached to the tubing's other end. In use, the detonator is removed from the coil and attached to an explosive device. Then, the package is pulled away from the detonator and explosive, thereby uncoiling the tubing through the end plate for deployment. The igniter is actuated for igniting the shock tubing and activating the detonator and explosive.

20 Claims, 5 Drawing Sheets

(56) References Cited

U.S. PATENT DOCUMENTS

| | | | | |
|---|---|---|---|---|
| 4,699,059 | A * | 10/1987 | Kelly | C06C 5/00 102/275.7 |
| 5,147,040 | A * | 9/1992 | Koike | B65D 85/67 206/410 |
| 5,555,978 | A * | 9/1996 | Elsner | B65H 18/28 206/389 |
| 5,597,973 | A | 1/1997 | Gladden et al. | |
| 5,622,030 | A | 4/1997 | Steed et al. | |
| 5,714,712 | A | 2/1998 | Ewick et al. | |
| 6,272,996 | B1 | 8/2001 | O'Brien et al. | |
| 7,086,335 | B2 | 8/2006 | O'Brien et al. | |
| 7,650,993 | B2 | 1/2010 | Bawabe | |
| 8,684,178 | B1 * | 4/2014 | Solomon | B65H 75/364 206/408 |
| 9,470,571 | B2 | 10/2016 | Huang et al. | |
| 10,473,323 | B2 | 11/2019 | Squashic et al. | |
| 2004/0200372 | A1 | 10/2004 | Gladden | |
| 2005/0034748 | A1 | 2/2005 | Gadd et al. | |
| 2006/0144279 | A1 | 7/2006 | Bawabe | |
| 2014/0036519 | A1 | 2/2014 | Cloward | |
| 2017/0122710 | A1 | 5/2017 | Scheid et al. | |
| 2018/0080750 | A1 | 3/2018 | Olivares et al. | |
| 2018/0106583 | A1 | 4/2018 | Montano Rueda et al. | |

OTHER PUBLICATIONS

Written Opinion for Internaional Application No. PCT/US2020/023319, International Filing Date Mar. 18, 2020, dated Jun. 25, 2020, 8 pages.

* cited by examiner

CORELESS-COIL SHOCK TUBE PACKAGE SYSTEM

FIELD OF THE INVENTION

The present disclosure relates to igniting devices and systems for explosives and, more particularly, to fuse cord and packaging for fuse cord.

BACKGROUND OF THE INVENTION

Shock tubes are a type of fuse cord or blasting cord used in non-electric blast initiation systems. A shock tube was originally described in U.S. Pat. No. 3,590,739 to Persson. Shock tubing typically comprises an elongated, hollow, flexible, small-diameter tube, the inner surface of which is coated with a reactive substance, for example, a thin layer of detonating or deflagrating explosive composition. Most commonly, this composition consists of a mixture of octogen (HMX) and aluminum powder. Later shock tube designs such as disclosed in U.S. Pat. No. 4,328,753 to Kristensen encompass multiple plastic layers to provide improved tensile strength and abrasion resistance.

In commercial blasting applications, the shock tubing provides a signal transmission device to transmit a signal to multiple blasting caps in demolition, mining, quarrying, or other applications, as known in the art. When initiated, the interior coating of the shock tube transmits a low energy shock wave that travels down the interior of the tube, without such shockwave breaching the tube sidewall. A detonator affixed to the end of the tubing is initiated by the shock wave, thereby setting off an attached explosive charge. As known in the art, shock tube-based initiation systems are typically employed and preferred over other systems because of the relative safety and reliability of such systems. The shock tube-based systems are non-electric, and thus are not affected by stray electrical currents, which could cause accidental initiation. Also, the shock tube-based systems do not require special electrical blasting machines, as is required for electric blasting cap systems.

In commercial applications, a firing device containing a percussion primer is typically used to initiate the shock tube. For military applications, a self-contained system is desirable. In military systems, an end fitting can be used to position a percussion primer on the end of the shock tube. This type of fitting and initiation system is disclosed in U.S. Pat. No. 6,272,996 B1 to O'Brien et al.

In the field, a spring loaded firing pin device is typically attached to the assembly and used to fire the percussion primer for initiating the shock tube.

More recently, products have been developed for the military with the firing device permanently affixed to the shock tube lead in the factory. This results in a totally self-contained initiation system being delivered in one package to the field. This type of initiation system is disclosed in U.S. Pat. No. 7,086,335 to O'Brien et al. As disclosed in this application, the firing devices are mounted on the flange of the spool. The shock tubing is wound around the spool and one or more detonators are crimped to the end of the shock tube.

Typically, the length of shock tube on a spool can vary from 80 feet to 1,000+ feet. The length of shock tube allows the field blaster to retreat a desired distance between the charge the detonator is initiating and the firing device that initiates the blast. This system is useful and has been deployed extensively in military field applications. However the use of a spool (and, of course, box) greatly increases the overall weight and volume of the shock tube package. For some applications, such as covert operations, it is desirable to have a self-contained detonator assembly that is easily carried by a person or one that will fit into a pocket on a vest.

SUMMARY OF THE INVENTION

According to some embodiments of the present disclosure, coreless-coil shock tube package systems and methods for packaging shock tubing are provided. The package system includes a "coreless" bundle of shock tubing, by which it is meant that the tubing bundle is not supported or contained by being wrapped around a spool or other supporting structure. The tubing bundle may be a generally cylindrical (in overall shape) coil of shock tubing. Optionally, two washer-like end caps or plates abut the ends of the tubing coil to assist in supporting the coil axially. Also, in an embodiment, a self-adhering overlapping, tape-type outer wrap partially covers the coil and end plates. The tape-type outer wrap may be formed of silicone.

Typically, one end of the tubing (referred to herein as the "inner" end) is positioned at the interior of the coil, and the other end of the tubing (referred to herein as the "outer" end) is positioned on the outside of the coil. Optionally, a detonator is attached to the tubing's inner end and is then tucked or moved into the coil, through one of the end plates, for convenient storage and transport. Also, a percussive initiator device ("igniter") may be attached to the tubing's outer end and secured in place against the outside of the outer covering. In use, the detonator is removed from the coil and attached to an explosive device in a conventional manner. To deploy the tubing, the coil package is pulled away from the detonator and explosive, thereby uncoiling the tubing through the end plate (or through the end of the coil if no end plates are used). Then, the igniter is actuated, igniting the shock tubing, whose interior percussive "signal" in turn actuates the detonator, igniting the explosive.

As should be appreciated, the coreless-coil shock tube package system relies upon the inherent resiliency of the shock tube itself for eliminating the need for a bulky internal core structure, for example, a spool. The self-adhering overlapping, tape-type outer wrap envelops the exterior of the coiled shock tube, resulting in a compact, lightweight package that can be readily carried in a backpack or concealed on one's person.

To manufacture one embodiment of the shock tube package system, the end plates are placed on a mandrel, spaced apart by a distance generally corresponding to the desired length of the shock tube package. Each end plate has a central hole whose diameter corresponds to the mandrel's diameter. Then, a desired length of shock tubing is wrapped around the mandrel between the end plates to form a coil. Subsequently, the coil and end plates are at least partially wrapped by the self-adhering overlapping, tape-type outer wrap (no heat is applied), which enables a tight constricting against the coil by the tape. Before the self-adhering overlapping, tape-type outer wrap is applied, the tubing ends may be positioned or secured for easy access after wrapping. Then, the mandrel is removed, and an igniter and detonator are attached to the tubing's ends.

BRIEF DESCRIPTION OF THE DRAWINGS

Embodiments of the present disclosure and the invention will be better understood from reading the following description of non-limiting embodiments, with reference to the attached drawings, wherein.

DETAILED DESCRIPTION

With reference to FIGS. 1-11*f*, an embodiment in accordance with the present disclosure is shown. FIGS. 1-10 illustrate different views of a coreless-coil shock tube package system 20 and FIGS. 11*a*-11*f* illustrate the steps of a method for packaging or manufacturing shock tubing in accordance with an embodiment of the present disclosure. The coreless-coil shock tube package system 20 includes a "coreless" bundle of shock tubing or coil 22, by which it is meant that the coil 22 is not supported or contained by being wrapped around a spool or other supporting structure. The coil 22 may be a generally cylindrical (in overall shape) coil of shock tubing. Optionally, two washer-like end caps or plates 26*a*, 26*b* abut the ends of the coil 22 to provide additional support to the coil in the axial direction of the coil 22. A self-adhesive tape covering 28 is applied as an outer cover or envelope which, at least partially, covers the coil 22 and may be wrapped about the end plates 26*a*, 26*b*. The self-adhesive tape covering 28 has an overlap 29 that enables the self-adhesive tape covering 28 to bind to itself as it is wound, and bound, about the coil 22.

Figure 10:
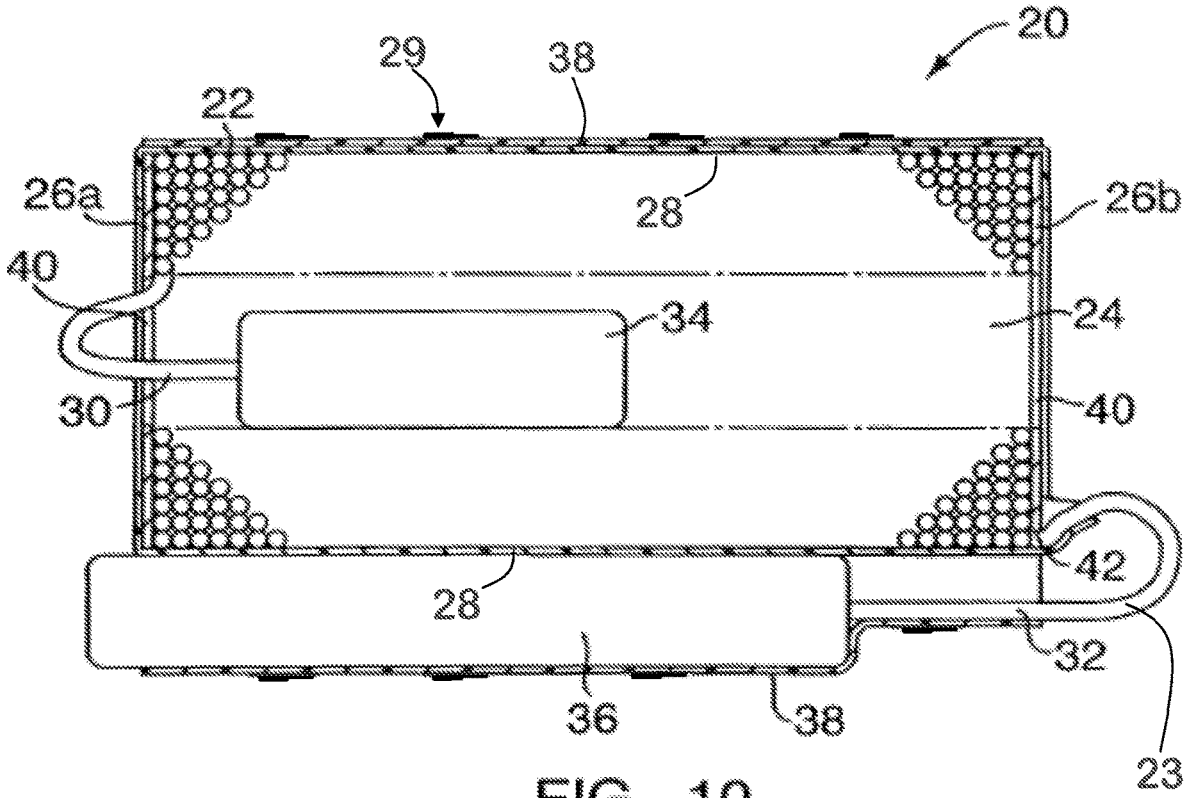
FIG. 10 is a cross-sectional view of a package system in accordance with an embodiment of the present disclosure showing a detonator and percussive initiator device.
Figure 11A:
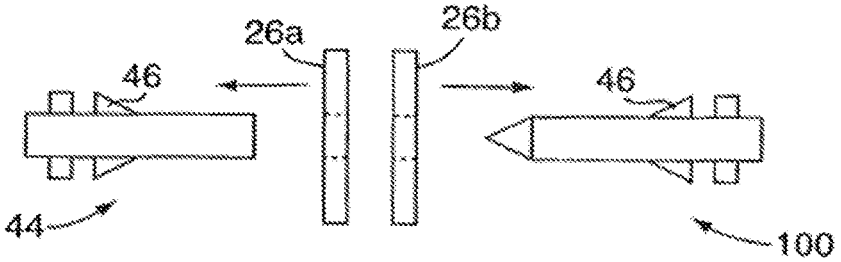
FIGS. 11*a*-11*f* are schematic diagrams of the steps of a method of manufacturing a shock tube package system in accordance with the present disclosure.
Figure 11B:
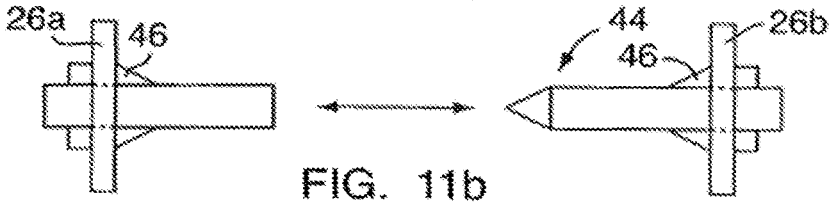
Figure 11C:
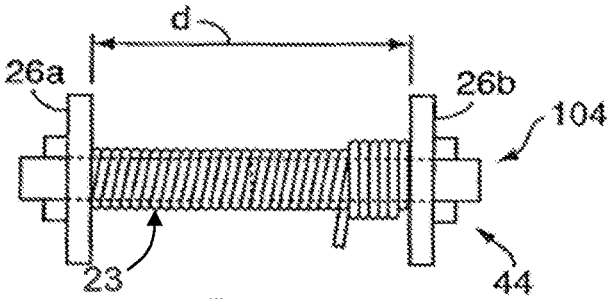
Figure 11D:
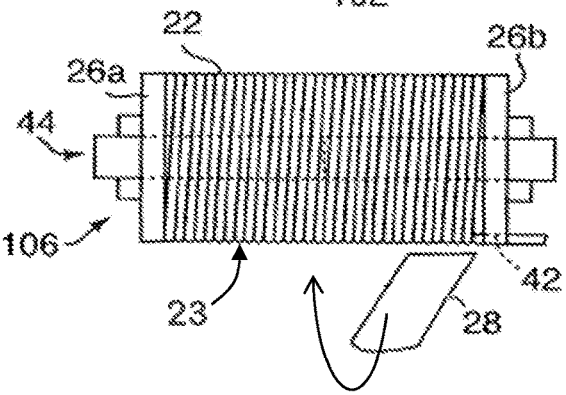
Figure 11E:
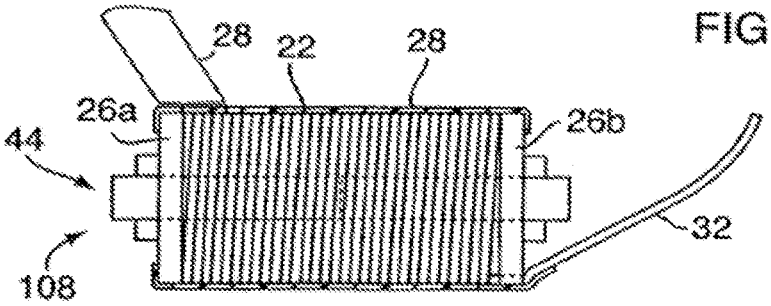
Figure 11F:
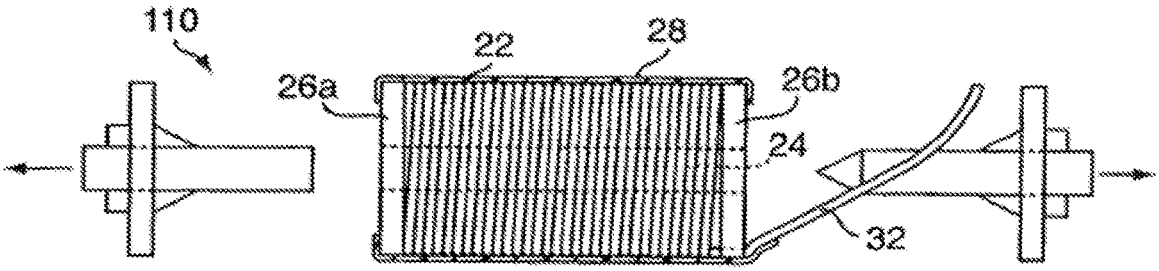

Typically, one end of the coil 22 (e.g., an "inner" end 30) is positioned at an interior 24 of the coil 22, and the other end of the tubing (e.g., an "outer" end 32) is positioned on the outside of the coil 22. Optionally (e.g., as shown in FIG. 10), a detonator 34 may be attached to the inner end 30 of the coil 22 and is then tucked into or placed within the coil 22. Such storage of the detonator 34 may be through an end plates 26*a*, 26*b*, for convenient storage and transport. Also, in some embodiments, a percussive initiator device (e.g., "igniter") 36 (e.g., as shown in FIG. 10) may be attached to the outer end 32 of the coil 22 and secured in place against the exterior surface of the self-adhesive tape covering 28 using, for example, a second layer self-adhesive tape 38, an adhesive, a mechanical attachment mechanism, or the like.

In use, the detonator 34 is removed from the coil 22 by pulling on a portion of the coil 22 (e.g., an end of the tubing) that may be left protruding through a central hole 40 in the end plate 26*a*. Alternatively, a pull string or tab may be attached to the detonator 34 or proximate tubing for use in removing the detonator from the interior 24 of the coil 22. The detonator 34 may then be attached to an explosive device (not shown) in a conventional manner. To deploy the tubing of the coil 22, the entire coreless-coil shock tube package system 20 is pulled away from the detonator and explosive, thereby uncoiling the tubing through the end cap 26*a* and out of the self-adhesive tape covering 28. Then, once at a desired distance, the igniter 36 is actuated, igniting the unspooled tubing of the coil 22, which in turn actuates the detonator 34, igniting the explosive device.

In some embodiments, the end plates 26*a*, 26*b* are generally the same size, shape, and dimensions (e.g., weight). In some embodiments, the end plates 26*a*, 26*b* may be washer-shaped, having the a central hole 40 formed therein. In some non-limiting embodiments, the end plates 26*a*, 26*b* may be thin and generally lightweight metal or polymer/composite. The end plates 26*a*, 26*b* may be manufactured from aluminum or other lightweight material such as nylon or other polymer, or from other materials such as steel. In some embodiments, an outer diameter of the end plates 26*a*, 26*b* is selected to match the outer diameter of the coil 22. Further, in some embodiments, a diameter of the central hole 40 of the end plates 26*a*, 26*b* may be selected to correspond to a desired diameter of the interior 24 of the coil 22.

Figure 1:
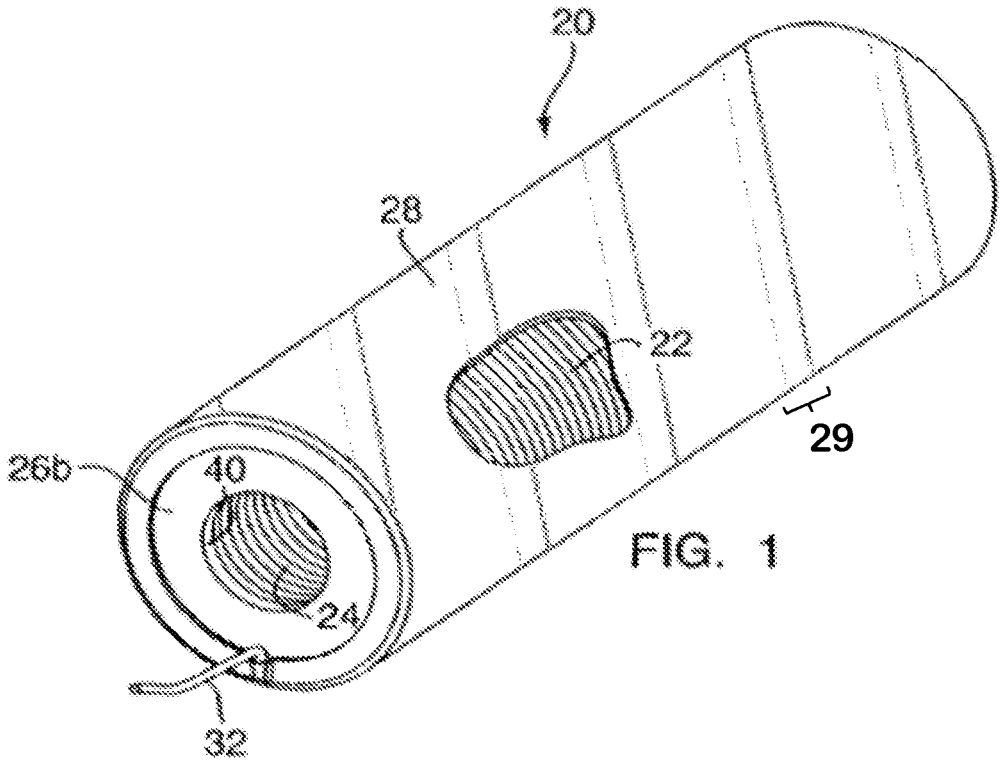
FIG. 1 is a perspective view of a coreless-coil shock tube package system, according to an embodiment of the present disclosure, showing an "outer" end of the shock tubing.
Figure 2:
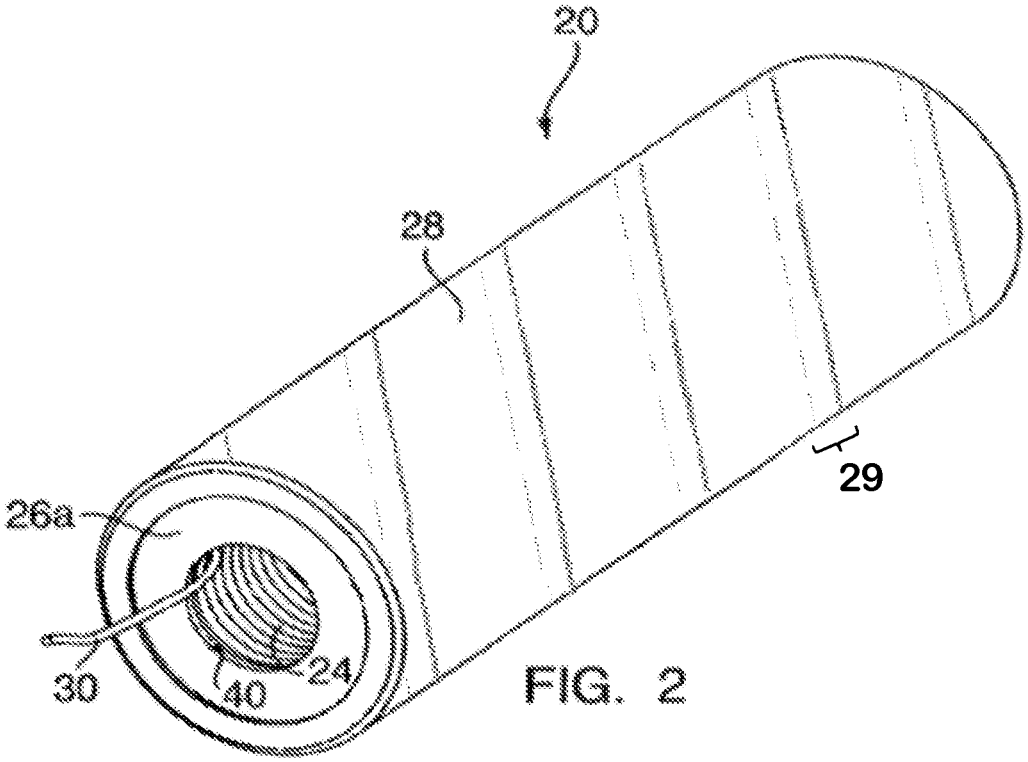
FIG. 2 is a perspective view of the package system showing an "inner" end of the shock tubing in accordance with an embodiment of the present disclosure.
Figure 3:
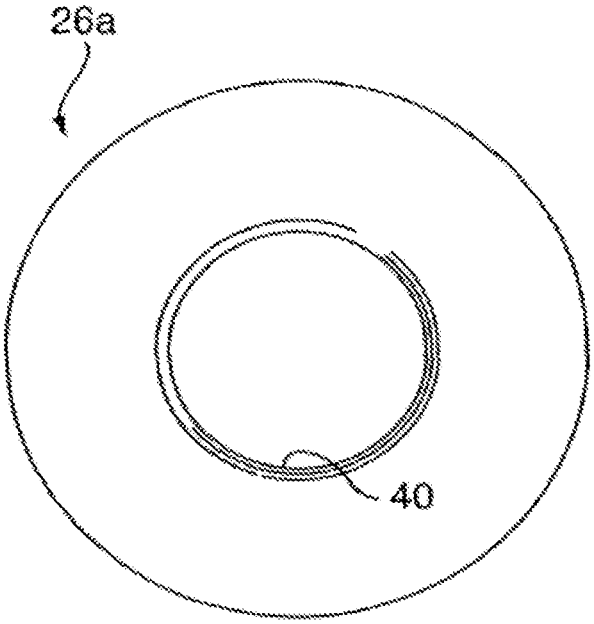
FIG. 3 is top plan and side elevation view of a first end plate or cap in accordance with an embodiment of the present disclosure.
Figure 4:
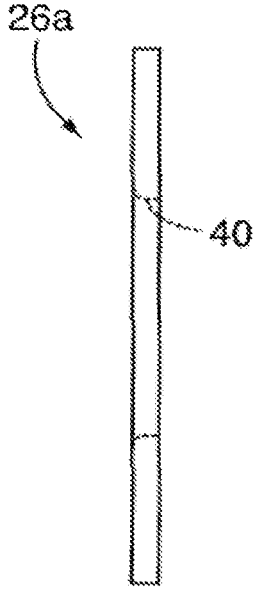
FIG. 4 is a side elevation view of the first end plate or cap of FIG. 3.
Figure 5:
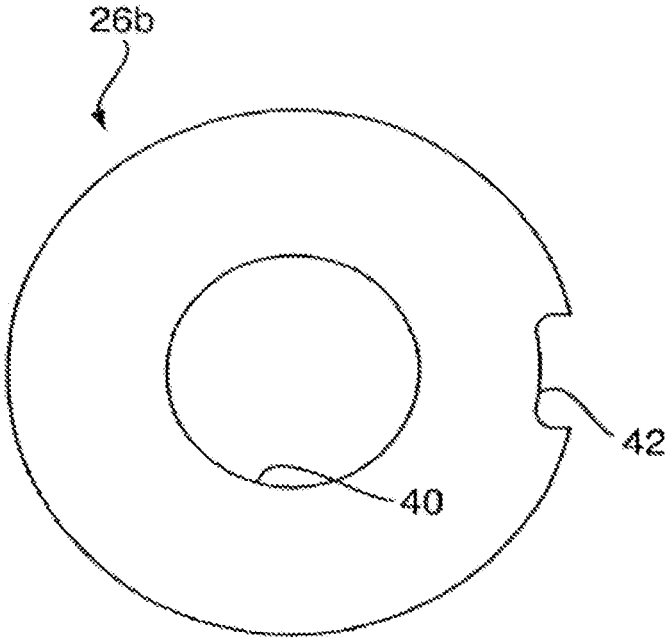
FIG. 5 is a top plan view of a second end plate or cap in accordance with an embodiment of the present disclosure.
Figure 6:
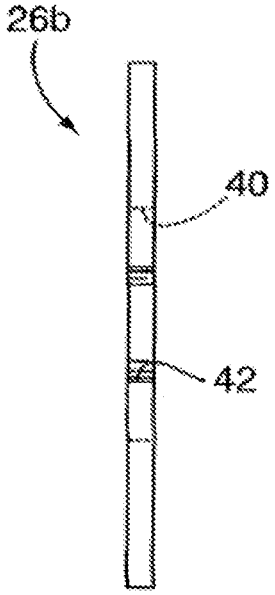
FIG. 6 is a side elevation view of the second end plate or cap of FIG. 5.
Figure 7:
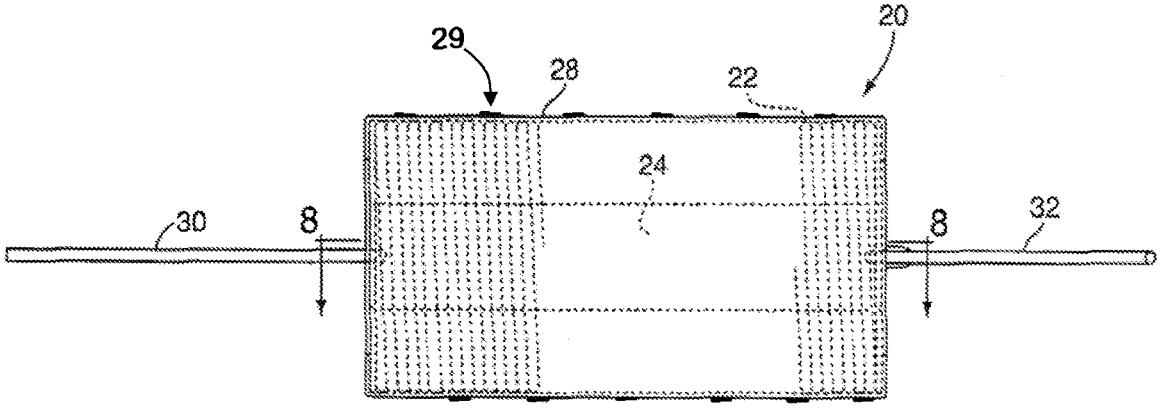
FIG. 7 is a lateral side elevation view of a package system in accordance with an embodiment of the present disclosure.
Figure 8:
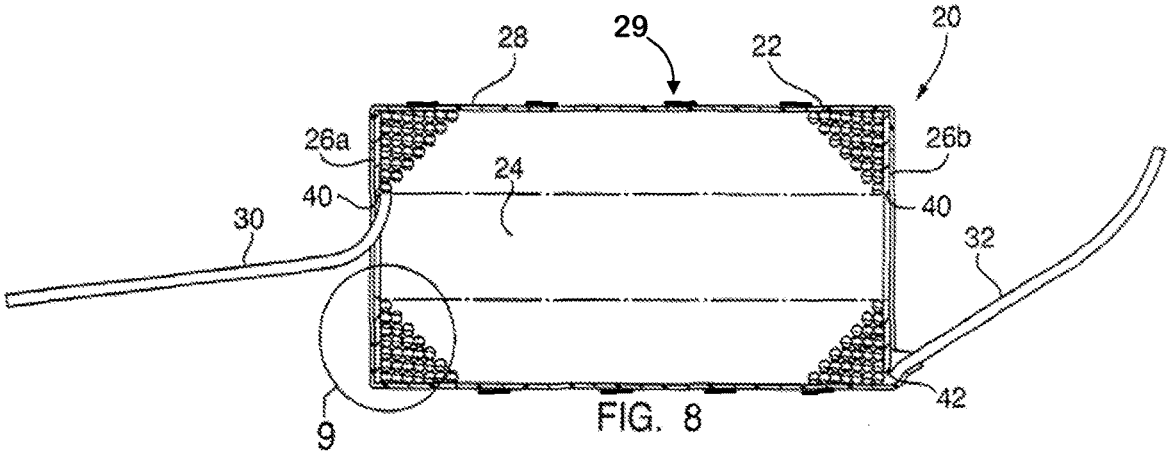
FIG. 8 is a cross-sectional view of the package system taken along line 8-8 in FIG. 7.
Figure 9:
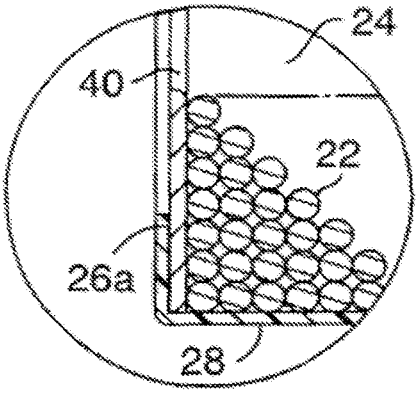
FIG. 9 is a detail view of the package system of FIG. 7, enlarging the area indicated in FIG. 8 and denoted as "9"

FIGS. 3-6 provide one non-limiting example of the geometry and shape of the end plates 26*a*, 26*b*. A first end plate 26*a* (as shown in FIGS. 3-4) has an annular shape, with the central hole 40 defined therein. The second end plate 26*b* (as shown in FIGS. 5-6), in this embodiment, includes a notch 42. The notch 42 formed in the second end plate 26*b* may be provided to facilitate passage of the outer end 32 of the coil 22 between the end plate 26*b* and the self-adhesive tape covering 28 (e.g., as shown in FIG. 1). The central hole 40 formed in the second end plate 26*b* may be optional, with the second end plate 26*b* being solid in some embodiments. The end plates 26*a*, 26*b* help to hold the coil 22, for example, axially, within the self-adhesive tape covering 28 (with the self-adhesive tape covering 28 providing radial and/or circumferential constraint). However, it is noted, that the end plates 26*a*, 26*b* are optional as the additional axial support may not be desired, depending on the physical characteristics of the bundle of shock tubing when coiled to form coil 22, the coiling method to wind the coil 22, and/or the type or configuration of the self-adhesive tape covering 28.

The coil 22 can be formed from any length of tubing, as desired. For example, the length of the tubing used to form the coil 22 may range from tens to hundreds of feet in length or more. The tubing of the coil 22 may be similar to that described in U.S. Pat. No. 4,328,753, or the shock tubing as described in U.S. Pat. No. 5,597,973, but with an outside diameter of approximately 0.100 inches, the contents of these patents hereby incorporated by reference in their entireties. This size of small-diameter shock tubing will yield the desired degree of resiliency and stress at the inside diameter of the coiled shock tubing, after removal from a mandrel in the manufacturing method described below. However, as should be appreciated, shock tubing with different diameters may be used.

The self-adhesive tape covering 28 may be a wrapping of wound tape applied to envelope and surround the outer edges of the end plates 26*a*, 26*b* and the coil 22. The self-adhesive tape covering 28 is arranged to overlap or wrap around the end plates 26*a*, 26*b*, but does not need to extend as far as the central openings 40 of the end plates 26*a*, 26*b*. The optional second layer 38 for holding the igniter 36 in place (e.g., as shown in FIG. 10) is similar, but does not necessarily overlap the end plates 26*a*, 26*b*. The self-adhesive tape covering 28 and the second layer 38 maybe silicone-based self-adhering tape. Advantageously, the use of such self-adhesive tape covering enables the elimination of heat applied to prior coreless-coil shock tube package systems during manufacture. Such prior systems relied upon shrink-wrap coverings which required the application of heat to a shrink-wrap sleeve that was positioned relative to and around a coil (e.g., coil 22). Such shrink-wrap systems are described in U.S. Pat. No. 7,650,993, the contents of which are incorporated herein by reference.

It is noted that the self-adhesive tape covering 28 is self-adhering. That is, the strings of self-adhesive tape covering 28 do not attach or bond to the coil 22 but rather only adhere at the overlap 29 between sections of the self-adhesive tape covering 28. The overlap may be as small or as large as needed to provide adequate binding and constraint to the coil 22 contained therein. During manufacture, a strip of self-adhesive tape may be wound about the coil 22, with the overlap 29 provided to ensure that once applied, the wound strip of tape will form a covering that contains the coil 22. The amount of overlap 29 may be selected to ensure that the tape does not unbind during use or transport.

As noted, the detonator 34 is operably connected to the inner end 30 of the coil 22 of shock tube. The detonator 34 may be a device made in accordance with U.S. Pat. No. 6,272,996. Also, the detonator 34 may be positioned inside the coil 22 for reducing the volume of the resulting coreless-coil shock tube package system 20. The igniter 36 is operably connected to the outer end 32 of the tubing of the coil 22, and is held in place by the second layer 38. The igniter 36 may be a device constructed in accordance with U.S. Pat. No. 6,272,996. This patent is hereby incorporated by reference in its entirety. Optionally, the coreless-coil shock tube package system 20 may be provided without a detonator or igniter, in which case these or similar devices would be connected to the coil 22 by a user in the field or otherwise. As should be appreciated, the igniter may be attached to the package of the coil 22 using an adhesive, elastic bands, or the like, in the field or during manufacturing. The igniter and detonator are sometimes collectively referred to herein as "shock tube devices," by which is meant a device either for actuating a shock tube or being acted upon by a shock tube signal.

As noted above, the shock tubing is provided as a "bundle," which refers generally to configurations where a length of shock tubing is wound in a compact manner or otherwise compactly arranged. Thus, the shock tubing bundle may be in the form of a coil, or, for example, it could comprise successive short lengths of the tubing folded back over on one another. The bundle does not have to be cylindrical in overall shape, and could be other shapes. Thus, in one non-limiting embodiment of the present disclosure, the bundle of shock tube may be characterized as packaged shock tubing comprising a bundle consisting of a compactly arranged length of shock tubing (e.g., no spool or other support) and a self-adhering tape cover that maintains the length of shock tubing in a bundled manner, for example, in a compact arrangement.

The coreless-coil shock tube package system 20 is optionally provided with a tear strip (not shown) integral with and/or operably attached to the outer cover 28 for quickly and easily removing the outer cover if desired. For example, for some applications, and especially those involving short lengths of shock tubing, the user may want to remove the outer cover for deploying the coil 22 of shock tubing without having to uncoil it through end plates 26*a*, 26*b* and/or self-adhesive tape covering 28. One such example, of a tear strip may be to unbind or unwind the self-adhering tape strip. In another example, the tear strip may be arranged to cut through or separate the tape of the self-adhesive tape covering 28. In other applications, the self-adhesive tape covering 28 may be cut using a knife, scissors, or other cutting implement. In some such embodiments, the cutting implement may be selected to prevent cutting or damaging the tubing of the bundle or coil.

FIGS. 11*a*-11*f* show an embodiment of a method for manufacturing a coreless-coil shock tube package system in accordance with the present disclosure. To do so, at Step 100 (FIG. 11*a*), the end plates 26*a*, 26*b* are placed on a generally cylindrical mandrel 44 so that a desired length of shock tube 23 can be wound to the diameter of the end plates 26*a*, 26*b*. The end plates 26*a*, 26*b* are spaced apart by a distance that is a function of the diameter of the end plates 26*a*, 26*b* and the desired tubing length. This distance "d" can be approximated by: $d \approx r_o^2 \cdot L/(r_1^2 - r_2^2)$, where $r_o$ is the tubing outer radius, L is the tubing length, $r_1$ is the radius of the end plate (or, if no end plate, the desired radius of package), and $r_2$ is the radius of the hole of the end plate or mandrel.

The distance "d" also corresponds to the final coreless-coil shock tube package system. Step 102 (FIG. 11*b*) shows two disconnected halves of a compound mandrel being reconnected for winding the tubing 23; however, many different types of mandrels may be used and the one shown in the drawings is for illustrative purposes only. The mandrels 44 include retractable retainer clips 46 that are configured to releasably retain the end plates 26*a*, 26*b* to the respective mandrels 44.

Next, at Step 104 (FIG. 11*c*), the tubing 23 is wound around the joined mandrel 44 between the end plates 26*a*, 26*b*. During the winding, the winding of the tubing 23 is would to correspond the outside diameter of the coil 22 to the outside diameter of the end plates 26*a*, 26*b*. At Step 106 (FIG. 11*d*), the self-adhesive tape covering 28 is wrapped around the coil 22 of tubing 23 and at least the peripheral portions of the ends plates 26*a*, 26*b*. Then, at Step 108 (FIG. 11*e*), the self-adhesive tape covering 28 (the tape portion) may be cut and a final wrapping about the end plate 26*a* may be completed. Finally, at Step 110 (FIG. 11*f*), the mandrel 44 is removed.

As an alternative to the type of mandrel shown in FIG. 11, a slightly tapered, one-piece mandrel could be employed, with the diameters of the central holes in the end plates varying slightly from one another to correspond to the tapered mandrel for easy spacing and registration of the end plates on the mandrel. As should be appreciated, tapering also helps with removing the mandrel from the wrapped bundle/coil.

As noted above, optionally, a detonator 34 may be attached to the inner end 30 of the tubing 23 and inserted into the opening provided at one end of the coil 22, as shown in FIG. 10. Also, as shown in FIG. 10, an igniter 36 may be attached to the outer end 32 of the tubing 23 and optionally retained by the second layer 38 of the self-adhesive tape covering surrounding the coil 22 which is already bound by the self-adhesive tape covering 28.

As should be appreciated by those of skill in the art in view of the teachings herein, instead of tucking in or placing whichever device is attached to the inner tubing end, such device can be left on the outside of the coil and, optionally, removably secured to, for example, the end of the coil. Also, for use in certain applications, instead of attaching a detonator 34 to the inner end 30 of the tubing 23 and an igniter 36 to the outer end 32 of the coil 22, the igniter may be attached to the inner end and the detonator to the outer end. In this configuration, the detonator and coil would remain with the explosive device while the igniter is moved away from both. It might also be the case that the igniter would remain stationary (e.g., held by a soldier or other user) while the coil and detonator are moved in a direction of interest.

With or without the end caps 26*a*, 26*b*, the above-described method results in a convenient package that avoids the need for a bulky spool, thereby providing a lightweight and compact assembly that can be easily transported by those in the field. This method, and the product made in accordance with the method, obviates the need for relatively heavy spools of the type formerly used to provide the explosives expert in the field with shock tube in an easily transportable form.

Further, advantageously, by employed the self-adhesive tape covering, the use of a shrink wrap covering may be eliminated. As such, the application of heat to the coil 23 (or other components) may be avoided The advantages of embodiments of the present disclosure can be optimized if shock tubing of a minimum size is wound on a mandrel of minimum diameter. The above-noted small-diameter size shock tubing can yield a product of minimum dimensions (e.g., where the inside diameter is just large enough to accommodate a typical detonator, and where the outside diameter is on the order of 2 inches or less). Thus, in one non-limiting example, if the diameter of the end plate central opening 40 is approximately 0.75 of an inch, the outside diameter of the entire assembly (i.e., the coreless-coil shock tube package system) can be 2 inches or less. The axial length of a coil of these proportions will be dictated by the length of the shock tube to be accommodated, but typically can be on the order of approximately 4 to 6 inches in length, given the multiple (e.g., seven) layers of tubing which can be wound within these parameters using small-diameter shock tubing.

Since certain changes may be made in the above-described coreless-coil shock tube package system and method of manufacturing, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A shock tube package system comprising:

a coreless bundle of shock tubing; and a self-adhesive tape covering wound about at least part of an outer periphery of the bundle of shock tubing, wherein the self-adhesive tape covering forms an outer wrap that envelops the exterior of the coreless bundle of shock tubing, and wherein the self-adhesive tape covering comprises one or more overlapping tape strips that adhere to each other but not to the coreless bundle of shock tubing.

2. The shock tube package system of claim 1 wherein:

the coreless bundle of shock tubing is a generally cylindrical coil with a lateral side surface and two end surfaces; and the self-adhesive tape covering covers the lateral side surface and at least part of both end surfaces.

3. The shock tube package system of claim 2 further comprising:

first and second end plates respectively abutting the end surfaces of the coil of shock tubing and disposed between the coil and the self-adhesive tape covering.

4. The shock tube package system of claim 3 wherein:

the coil of shock tubing defines a longitudinal open interior space; the first end plate has a central opening for accessing the interior space; and a first end of the shock tubing is accessible through the central opening of the first end plate.

5. The shock tube package system of claim 4 further comprising:

a shock tube device operably connected to the first end of the shock tubing and tucked into the interior space of the coil of shock tubing through the central opening in the first end plate.

6. The shock tube package system of claim 5 further comprising:

a second shock tube device operably connected to a second end of the shock tubing and attached to an outside of the self-adhesive tape covering.

7. The shock tube package system of claim 6 wherein:

the second end plate is provided with an outer notch for facilitating passage of the second end of the shock tubing between the self-adhesive tape covering and the second end plate.

8. The shock tube package system of claim 6 wherein:

the second shock tube device is attached to the outside of the self-adhesive tape covering by a second covering.

9. The shock tube package system of claim 8 wherein:

the second covering comprises self-adhesive tape.

10. The shock tube package system of claim 2 wherein:

the coil of shock tubing defines a longitudinal open interior space; a first end of the shock tubing is accessible through the interior space; and the system further comprises a shock tube device operably connected to the first end of the shock tubing and tucked into the interior space of the coil of shock tubing.

11. The shock tube package system of claim 10 further comprising:

a second shock tube device operably connected to a second end of the shock tubing and attached to an outside of the self-adhesive tape covering.

12. The shock tube package system of claim 11 wherein:

the second shock tube device is attached to the outside of the self-adhesive tape covering by a second covering.

13. The shock tube package system of claim 12 wherein:

the second covering comprises self-adhesive tape.

14. Packaged shock tubing comprising:

a bundle consisting of a compactly arranged length of shock tubing; and a self-adhesive tape covering maintaining the length of shock tubing in a bundled manner, wherein the self-adhesive tape covering forms an outer wrap that envelops the exterior of the bundle, and wherein the self-adhesive tape covering comprises one or more overlapping tape strips that adhere to each other but not to the bundle.

15. The packaged shock tubing of claim 14 further comprising:

a shock tube device attached to a first end of the length of shock tubing.

16. The packaged shock tubing of claim 15 wherein:

the bundle defines a longitudinal open interior space; and the shock tube device is tucked into the interior space.

17. The packaged shock tubing of claim 15 wherein:

the shock tube device is attached to the outside of the self-adhesive tape covering.

18. The packaged shock tubing of claim 14 wherein:

the bundle defines a longitudinal open interior space; and the packaged shock tubing further comprises:

a first shock tube device attached to a first end of the length of shock tubing; and a second shock tube device attached to a second end of the length of shock tubing and attached to the outside of the self-adhesive tape covering.

19. The packaged shock tubing of claim 18 wherein:

the bundle is a generally cylindrical coil having a lateral side surface and two end surfaces;

the self-adhesive tape covering surrounds the lateral side surface and at least part of both end surfaces; and the packaged shock tubing further comprises first and second end plates respectively abutting the end surfaces of the coil and disposed between the coil and self-adhesive tape covering.

20. A method of manufacturing packaged shock tubing comprising the steps of:

winding a length of shock tubing around a mandrel to form a bundle;

wrapping a self-adhesive tape covering around at least part of the periphery of the bundle, wherein the self-adhesive tape covering forms an outer wrap that envelops the exterior of the bundle, and wherein the self-adhesive tape covering comprises one or more overlapping tape strips that adhere to each other but not to the bundle; and removing the mandrel from the bundle.

* * * * *